US005629060A

United States Patent [19]

Garwood

[11] Patent Number: 5,629,060

[45] Date of Patent: May 13, 1997

[54] PACKAGING WITH PEELABLE LID

[75] Inventor: Anthony J. M. Garwood, Zionsville, Ind.

[73] Assignee: Seawell North America, Inc., Wilmington, Del.

[21] Appl. No.: 170,254

[22] PCT Filed: Jun. 24, 1992

[86] PCT No.: PCT/AU92/00309

§ 371 Date: Mar. 3, 1994

§ 102(e) Date: Mar. 3, 1994

[87] PCT Pub. No.: WO93/01104

PCT Pub. Date: Jan. 21, 1993

[30] Foreign Application Priority Data

Jul. 1, 1991 [AU] Australia ..... PK6951

[51] Int. Cl.[6] ..... B32B 7/14; B30B 15/34; B65D 85/00

[52] U.S. Cl. ..... 428/35.2; 428/35.5; 428/35.7; 428/194; 428/200; 428/201; 428/202; 428/212; 428/349; 426/119; 426/129; 426/396; 53/453; 53/511; 53/559; 156/69; 156/292; 156/581; 156/583.1

[58] Field of Search ..... 426/396, 129, 426/119; 53/433, 453, 511, 559; 206/213.1, 497; 156/581, 583.1, 292, 69; 428/200, 201, 202, 194, 35.2, 35.5, 35.7, 212, 347, 349

[56] References Cited

U.S. PATENT DOCUMENTS

| | | | |
|---|---|---|---|
| 3,467,244 | 9/1969 | Mahaffy et al. | 426/111 |
| 3,481,100 | 12/1969 | Bergstrom | 53/433 |
| 3,997,677 | 12/1976 | Hirsch et al. | 426/396 |
| 4,114,348 | 9/1978 | Mahaffy et al. | 53/433 |
| 4,349,999 | 9/1982 | Mahaffy et al. | 53/139.2 |
| 4,685,274 | 8/1987 | Garwood | 53/433 |
| 4,735,675 | 4/1988 | Metz | 156/583.4 |
| 4,838,708 | 6/1989 | Holcomb et al. | 383/5 |
| 4,840,271 | 6/1989 | Garwood | 426/396 |
| 4,937,040 | 6/1990 | Holcomb et al. | 383/5 |
| 4,998,666 | 3/1991 | Ewan | 229/102 |
| 5,034,074 | 7/1991 | Thomas, Jr. | 156/69 |
| 5,103,618 | 4/1992 | Garwood | 53/433 |
| 5,141,594 | 8/1992 | Walter et al. | 156/583.1 |
| 5,155,974 | 10/1992 | Garwood | 53/510 |
| 5,226,531 | 7/1993 | Garwood | 206/213.1 |
| 5,334,272 | 8/1994 | Takata et al. | 156/69 |

FOREIGN PATENT DOCUMENTS

| | | |
|---|---|---|
| 65620/90 | 6/1992 | Australia . |
| 9103400 | 3/1991 | WIPO . |
| 9104199 | 4/1991 | WIPO . |

*Primary Examiner*—Ellis Robinson
*Assistant Examiner*—Rena L. Dye
*Attorney, Agent, or Firm*—Foley & Lardner

[57] ABSTRACT

A method of sealing a peelable lid (7) to a package is disclosed. The package contains a base (1) and a potentially rupturable flexible web (5) of plastics material covering the base (1) which together define a sealed space therebetween. The lid (7) is in turn sealed above the flexible web (5). The method comprises the steps of: 1) placing a lid (7) over a thin flexible web (5); 2) sealing the lid (7) to the thin flexible web (5) over the base (1) with a strip like seal (13) which extends around the perimeter of the space so the lid (7) will be sealed at the same region as the thin flexible web (5) is sealed to the base (1). The sealing is achieved by a thermosealing process which provides a temperature gradient across the width provides the seal (13) with a peelable adhesion gradient across its width so that when the lid (7) is stripped from the package, it will be unlikely to rupture the thin flexible web (5). A package made by the method is also disclosed.

42 Claims, 2 Drawing Sheets

PACKAGING WITH PEELABLE LID

FIELD OF THE INVENTION

This invention relates to improved packaging with peelable lid and relates particularly, but not exclusively, to packaging of the plastics material type wherein there is a generally rigid base, and a potentially rupturable, flexible web of plastics material over the base and sealed to the base to define a space therebetween and wherein there is a relatively rigid lid sealed over the flexible web.

DESCRIPTION OF PRIOR ART

Hitherto, packaging of the above type has been produced. An example of such packaging is disclosed in U.S. Pat. No. 4,685,274 where A. J. M. Garwood is listed as the inventor. The packaging disclosed in the aforementioned U.S. patent specification relates to packaging whereby foodstuffs can be kept for a substantial period of time with enhanced keeping properties. Typically such packaging comprises a plastics material base, foodstuffs such as red meat placed on the base, a thin flexible web skin packaged to the base over the goods and a lid provided over the base to define a space between the lid and the plastics web. The space contains a gas for enhancing the keeping properties of the meat by permeating through the flexible web. The aforementioned specification also makes mention of the fact that the lid can be peelable from the base whereby to allow gases such as oxygen to then permeate through the flexible web to enhance the restoration of a bright red colour to the meat which may have turned dark brown/purple during the storage life of the meat in the package.

Thus, whilst the present invention has particular application to packaging of the above type it is not intended to be limited to such packaging and has application generally to packaging where goods are packaged to a base by a thin flexible web and wherein a lid is required to be placed over the thin flexible web and subsequently stripped therefrom without rupturing the thin flexible web.

In the embodiments of the packaging described above in relation to the U.S. patent specification, we have experienced rupturing of the thin flexible web when the lid is peeled from the package. This rupturing occurs at the edges of the seal which are innermost relative to the package during the peeling process.

OBJECT AND STATEMENT OF THE INVENTION

It is an object of the present invention to provide an improved method and product whereby rupturing of the thin flexible web around the seal is inhibited during the peeling process.

This desired end result can be achieved by providing the seal with a peelable adhesion gradient across the width of the seal and wherein the greatest adhesion is outermost of the package.

Therefore in accordance with the first broad aspect of the present invention there may be provided a method of sealing a peelable lid to a package which contains a base and a potentially rupturable flexible web of plastics material covering and held to the base which together define a space therebetween, said method comprising the steps of:

1. Placing said lid over said thin flexible web;
2. Sealing said lid to said thin flexible web over said base with a strip like seal which extends around the perimeter of said space so said lid will be sealed at the same region as the thin flexible web is held to said base, said sealing being by a thermosealing process which provides a temperature gradient across the width of the strip like seal during the sealing process, whereby to provide said seal with a peelable adhesion gradient across the width of said strip like seal there being a lower adhesion adjacent the space so that when said lid is stripped from said package, the stripping of said lid will be unlikely to rupture said thin flexible web.

In accordance with a further broad aspect of the present invention there may be provided a package comprising a base, a potentially rupturable flexible web of plastics material covering said base and adhered to said base to define a space therebetween, and a lid sealed to said flexible web at the same region as said flexible web is adhered to said base, the sealing of said lid to said flexible web being by way of a strip like seal which extends around said space, and wherein there is a peelable adhesion gradient across the width of the strip, there being a lower adhesion adjacent the space, whereby to inhibit against rupturing of said flexible web when said lid is peeled from said package.

Most preferably said strip like seal is formed by two sealing strips which run generally parallel to each other around the perimeter of said space and wherein the outermost strip has a greater peeling adhesion than the innermost strip.

BRIEF DESCRIPTION OF DRAWINGS

In order that the invention can be more clearly ascertained examples of preferred embodiments will now be described with reference to the accompanying drawings wherein:

Referring now to FIG. 1 there is shown a packaging having a base 1, goods 3 on the base, a flexible web of potentially rupturable plastics material 5 covering the goods 3, and a lid 7 over the base 1. The lid 7 closes a space 9 between the lid 7 and the flexible web 5. The goods 3 are received in a space 11 which is a depression in the base. Typically the base 1 and the lid 7 are of rigid plastics material such as PVC and the flexible web 5 is of a thin flexible plastics material which will permit wrapping onto the goods 3. The technique for effecting such wrapping is fully disclosed in the aforementioned U.S. patent specification. The flexible web 5 is gas permeable and the space 9 is filled with a gas which can pass through the flexible web 5 by permeation to contact the surface of the goods 3 so as to maintain the keeping qualities of the packaged good 3 which may conveniently be red meat. In the embodiment disclosed, the base 1 and lid 7 are substantially gas impervious.

Figure 1:
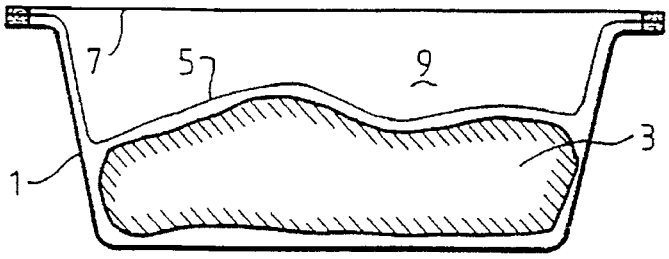
FIG 1 is a cross-sectional view taken through a prior art package of the type disclosed in U.S. Pat. No. 4,685,274.
Figure 2:
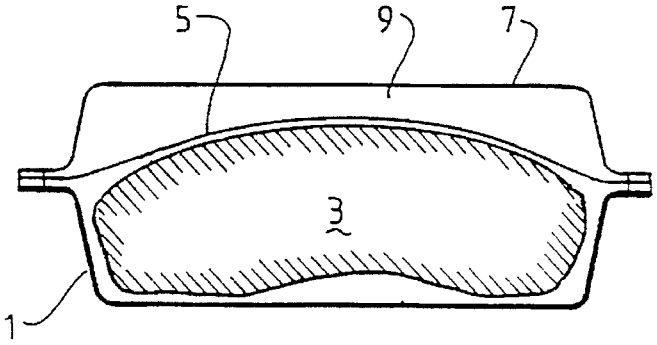
FIG. 2 is a view similar to FIG. 1 showing a different form of prior art package, shown for example in PCT patent specification no. PCT/AU87/00297.

The embodiment of FIG. 2 is slightly different to that in FIG. 1 as here the height of the goods 3 extends above the upper surface of the base 1. In this embodiment, the flexible web 5 is stretched over the goods 3 and onto the upper surface of the base 1 and then adhered thereto. In this way, the flexible web 5 compresses the goods 3 onto the base 1 and inhibits against flopping around of the goods 3 on the base 1. The lid 7 is shaped so as to provide the space 9 similar to that in FIG. 1.

Figure 3:
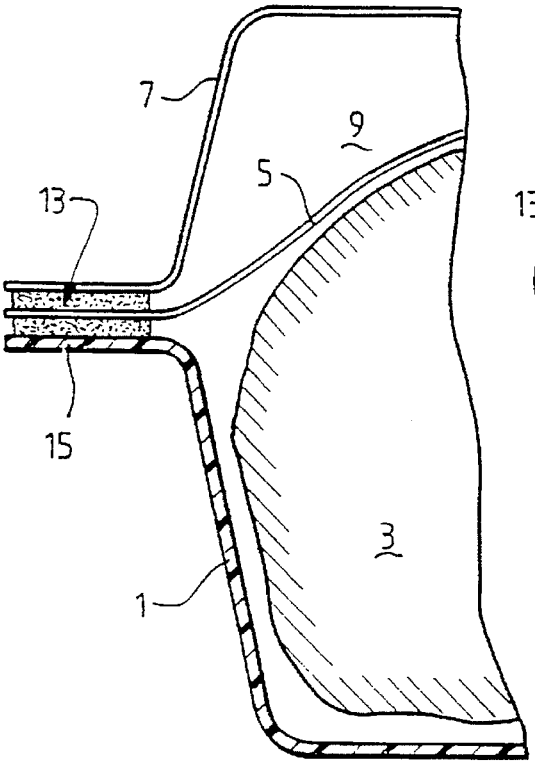
FIG. 3 is a close-up view showing an edge portion of the packaging in FIG. 2.

FIG. 3 shows a close-up view of a corner edge of the packaging shown in FIG. 2. It should be appreciated that the same points explained in relation to this embodiment apply in relation to the embodiment shown in FIG. 1. The flexible web 5 is held to the base 1 by a seal 13 which comprises a strip like seal which extends completely around the perimeter of the base 1 over a lip 15 of the base 1. The seal 13 is typically effected by a thermo sealing process. Thus, a heated platen (not shown) is brought down to clamp together the edge surfaces of the lid 7, the flexible web 5 and the lip 15, and the plastic materials are melted thereby resulting in sealing of the components one to another. The aforementioned specification discloses that the sealing may be such as to permit the lid 7 to be peeled from the base 1 leaving the flexible web 5 intact and sealed to the base 1. This is required so as to permit oxygen which is in atmospheric air or in another gas to permeate the flexible web 5 and contact the surface of the goods 3, such as red meat, to attempt to restore a bright red colour to the meat. It has been found that when meat is packaged in this way, it deteriorates in colour over a period of time and turns a dark brown or purple deoxymyoglobin. By removing the lid 7, oxygen in the air can then contact the surface of the meat to turn it a bright red oxymyoglobin colour. This, in turn, permits the meat to be perceived to be totally fresh and of the normal colour associated with red meats.

The peelability of the lid 7 has been obtained by suitable choice of plastics material for the lid 7 and the flexible web 5. Thus, whilst there is a substantially gastight seal effected by such seal 13, the seal between the flexible web 5 and the lid 7 is such that the lid 7 can be peeled therefrom leaving the flexible web 5 intact and sealed on the base 1 without substantially affecting the seal between the flexible web 5 and the lip 5. It has been discovered however, that when the lid 7 is peeled in this way, the flexible web 5, being potentially rupturable, because of its relatively thin nature, can tear on the innermost side of the seal 13 relative to the packaging during the peeling process. This has been perceived to occur as a result of the sharp transition of adhesion gradient at the inner edge of the seal 13.

Figure 4:
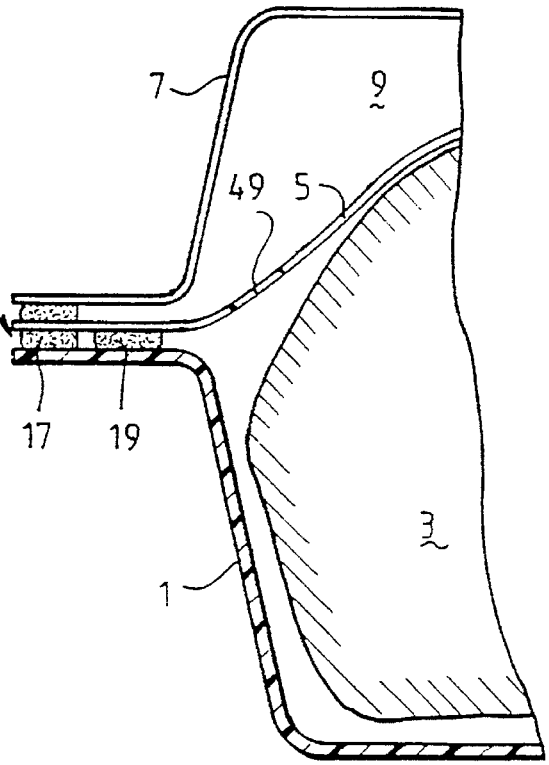
FIG. 4 is an example of a preferred embodiment of the present invention showing a view similar to that in FIG. 3.

Referring now to FIG. 4, there is shown one example of a preferred embodiment wherein the strip-like seal 13 which extends completely around the perimeter of the packaging is formed by two sealing strips 17 and 19 which extend side by side. Thus, two separate platens (not shown) can be used at different temperatures so that strips 17 and 19 can be produced with different adhesive strengths. Strip 17 will have a higher peelability adhesive gradient than strip 19, in other words, there will be greater adhesive strength in strip 17 than in strip 19. Thus, strip 17 can provide high adhesion of lid 7 relative to the flexible web 5 while strip 19 will provide lower adhesion. The adhesion may be chosen to be just sufficient to permit a gas tight adhesive seal in strip 19 but in strip 17 it will be sufficient to provide both a gas tight adhesive seal and positive but peeling adhesion of lid 7 to flexible web 5.

Figure 5:
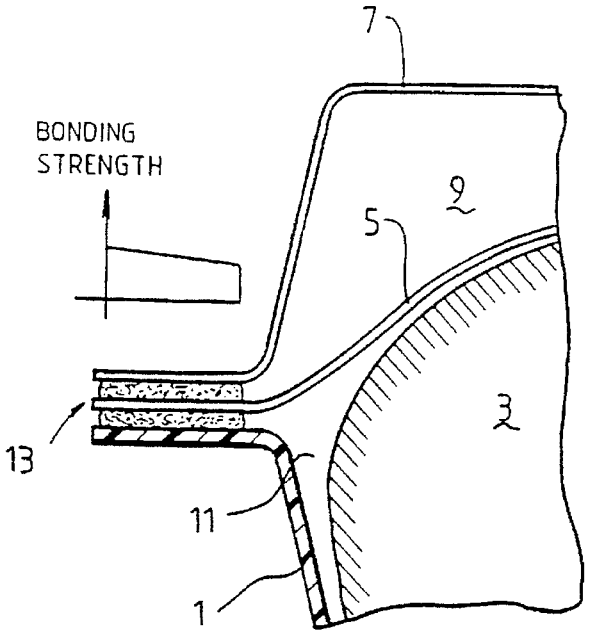
FIG. 5 is a view similar to FIG. 4 showing another example of a preferred embodiment of seal.

FIG. 5 shows an example similar in concept to that shown in FIG. 4. Here, the strip seal 13 comprises a single strip which extends around the package and around the space 11 but in this case, the strip 13 has an adhesion gradient across its width as shown diagrammatically by the graph in FIG. 5. Thus, the outermost perimeter of the strip has higher adhesion than the innermost perimeter of the strip. In this embodiment it is achieved by a single strip 13 as distinct from two separate strips 17 and 19 in FIG. 4.

Figure 6:
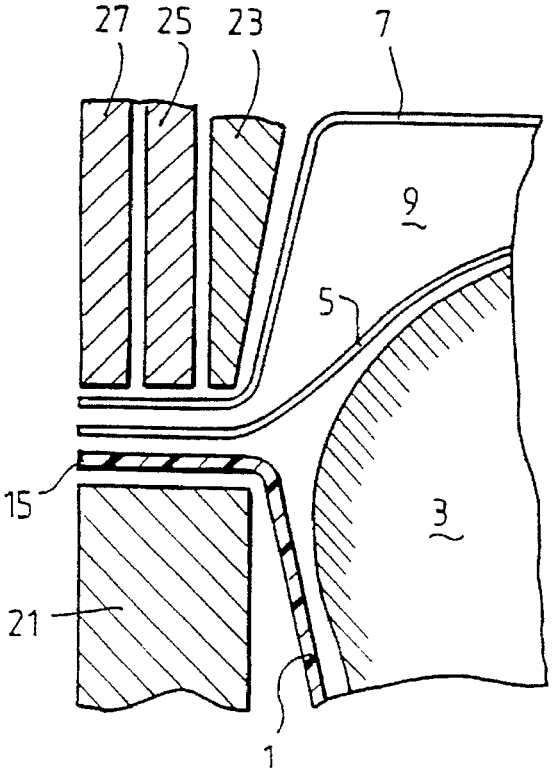
FIG. 6 is a view similar to that of FIGS. 4 and 5 showing apparatus for effecting such a seal.

FIG. 6 shows an example of how the two strips 17 and 19 of FIG. 4 can be produced during manufacture. In this case, a lower chamber part 21 is provided to receive bases 1 with goods 3 on the bases 1 and with the thin flexible 5 over the goods 3. The lip 15 of the base locates on the upper surface of the lower chamber part 21. A cooled platen 23 can be provided to push the lid 7 and the flexible web 5 down onto the lip 15 without effecting sealing. Two further platens 25 and 27 can then be lowered either together or at different times to effect sealing strips 17 and 19 shown in FIG. 4. In this connection, platen 27 will be at a higher temperature than platen 25. Thus, platen 27 will effect greater adhesive strength in the seal strip 17 and greater peelability removal forces will be required across the seal strip 17 than across seal strip 19. Platen 23 can be cooled by known techniques such as by using water passing through suitable hollow cores thereof. Platens 25 and 27 can be heated by known means such as by hot water or steam or by an electric heating element which all can be suitably thermostatically controlled and which passes through suitable hollow cores thereof.

Figure 7:
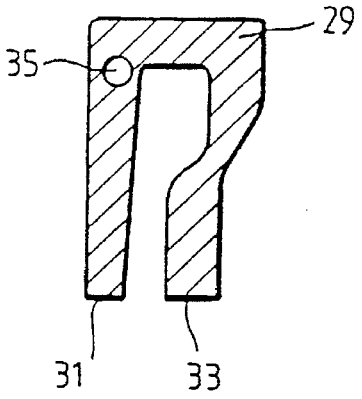
FIGS. 7 and 8 show different examples of apparatus which can be used in the same manner as that shown in FIG. 6.

FIG. 7 shows an example of an edge portion of a further platen 29 which can be used to produce two different temperature surfaces 31 and 33 and thereby simulate the effect of platens 25 and 27 in FIG. 6. Here, platen 29 can be made of suitable material such as machine steel and contain a core passageway 35 through which hot water or steam can pass. The passageway 35 is closer to face 31 than to face 33 and hence face 31 will be elevated to a higher temperature than face 33.

Figure 8:
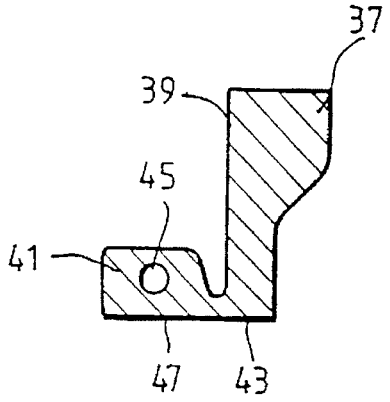

FIG. 8 shows a further embodiment to produce a sealing strip 13 shown in FIG. 5. Here, the platen 37 has a main bulky portion 39 with an extending foot 41 and a thin interconnecting portion 43. A core passageway 45 extends through the foot 41 and hot water or steam can be arranged to pass through the passageway 45 thereby heating the outermost edge (left hand side) as shown in FIG. 8 to a higher temperature than the right hand edge of FIG. 8. Thus, the surface 47 will have a temperature gradient being highest at the left hand side and lowest at the right hand side.

The plastics materials are preferably chosen such that the base 1 adheres to the flexible web 5 at a lower temperature than the lid 7. In this way, the flexible material 5 will be adhered to the base 1 on the innermost edge of strip 19 whilst the lid 7 will be only partially adhered or may not even be adhered at strip 19. Thus, as the lid 7 is peeled from the packaging, it will be unlikely to rupture the flexible web 5 in the region of the strip 19.

Typical examples of plastics material for lid 7 comprise APET (Amorphous Polyethylene Terephthalate) which has an overall thickness of approximately 0.013 inches. The face or undersurface of lid 7 relative to the package may comprise a blend of 90% APET plus 10% PETG 6763. The thickness of the blend coating or layer may be 0.0015 inches. Thus, the lid 7 may be a multi-layered web which is formed either by bonding of two separate webs or by a co-extrusion or by a coating of one web to the other.

The flexible web 5 may comprise a plasticised polyvinyl chloride of 0.001 inches thickness.

The base 1 can comprise a material of APET of thickness of 0.020 inches which can have a layer on the innermost face to abut with flexible web 5 of a blend of 85% PETG 6763 an amorphous polymer based on poly(ethylene terephthalate) having a number average molecular weight of about 26,000 and 15% PET 5116 a terephthalate copolyester having a low postextrusion crystallinity and low glass-transition temperature of about 58° C. which enables heat-seal bonds to be achieved over a temperature range of 95° to 205° C. This layer, or web, can have a thickness of about 0.0015 inches. Thus, the base material may be a web coated or bonded with a further web or it may be a co-extruded web. The above materials and thickness are preferred when using Eastman Chemical Products, Inc. Plastics.

In an alternative material combination the lid 7 may have a total thickness of 0.015 inches and be formed of a co-extruded laminate of an outer layer relative to the packaging of Eastman PET 9921 a condensation polymer of a poly(ethylene terephthalate) thermoplastic copolyester produced by a continuous meltphase polymerization process followed by a solid-state polymerization process and an inner layer relative to the packaging comprising a blend of Eastman PET 9921 of 84% and PETG of 6763 of 16%. The percentages are by weight. The outer layer can be 0.013 inches thick and the inner layer 0.002 inches thick.

The flexible web 5 may have a total thickness of 0.001 inches and be formed of pPVC.

The base 1 may have a total thickness of 0.018 inches and be formed of a co-extruded laminate of an inner layer relative to the packaging comprising a blend of Eastman PETG 6763 of 50% and Kodabond PET 5116 of 50%. The percentages are by weight. The outer layer may be Eastman 9921. The inner layer can be 0.002 inches thick and the outer layer can be 0.016 inches thick.

In the above material combination the platen 27 can be heated to 400° F. and platen 25 can be heated to 385° F.

Thus, in these examples the lid 7 and the base 1 have a PETG component in their surfaces facing the flexible web 5 of PPVC at the seal. Accordingly good sealing can be effected and subsequent peel of the lid is possible.

The above materials have been found particularly suitable in a packaging of the type used for storing perishable goods such as red meats wherein the package contains a desired gas in the space 9 which can permeate the flexible web 5 to contact the surface of the goods 3 to enhance keeping properties of the goods 3. After a period of time, should the red meat discolour by deoxymyoglobin, the lid 7 can be peeled from the package whilst leaving the flexible web 5 held to the base 1 without rupturing around the seal 13. In this way, oxygen or other gas can pass through the web 5 and contact the surface of the goods 3 to provide for further treatment of the goods 3 such as restoration of a desired colour.

It is particularly required that the flexible web 5 not rupture when the lid 7 is stripped therefrom, as a ruptured package does not have the same aesthetic qualities to an intending purchaser as a totally unruptured package.

It has been observed that when the lid 7 is removed oxygen in atmospheric air or in other gases takes some time to permeate the flexible web 5. Thus, when the oxygen concentration under the membrane is in the approximate percentage ration to the volume of gas under the membrane of 0%–5% metmyoglobin has a tendency to form on the meat. This can result in a permanent dark brown colouring to the meat and this cannot be changed to the required bright red oxymyoglobin colour even after being subjected to large amounts of oxygen. Thus, it is desirable to permit quick transfer of oxygen through the flexible web 5 once the lid 7 is removed. This can be achieved by providing apertures 49 in the flexible web 5, preferably in that portion of the flexible web 5 that spans the space between the sides of the meat and the base 1. The apertures 49 may be pre-provided in the flexible web 5 before the meat is packaged or provided after removal of the lid 7. The apertures 49 can be provided by a suitable punch which will produce apertures 49 in a known or predetermined array in the flexible web 5. By having apertures 49 in a predetermined array they will not detract from the aesthetic appearance of the package. If desired, the apertures 49 may be covered by a sales label after the meat has turned to the bright red oxymyoglobin colour.

Modifications may be made to the present invention as would be apparent to persons skilled in the art of producing packaging. These and other modifications may be made without departing from the amhit of the invention, the nature of which is to be determined from the foregoing description.

I claim:

1. A method of sealing a peelable lid to a package which contains a base and a flexible web of plastics material covering and held to the base at the perimeter thereof which together define a space therebetween, said method comprising the steps of:

placing said lid over said flexible web;

sealing said lid by a thermosealing process to said flexible web over said base with a strip seal which extends around the perimeter of said base, said seal having an inner portion and an outer portion, said thermosealing process providing a temperature gradient across the width of the striplike seal from the inner portion to the outer portion thereof, said seal further having a peelable adhesion gradient across the width of said strip seal, the inner portion of the seal which is adjacent the space having an adhesion which is lower than the adhesion of the outer portion of said seal so that when said lid is stripped from said package, said flexible web is unlikely to rupture.

2. Method as claimed in claim 1 wherein said strip like seal is produced by the step of applying a heated platen which forms the strip like seal to the lid and effecting a thermo sealing adhesion.

3. A method as claimed in claim 2 wherein said heated platen is a two part platen which forms said strip seal wherein said seal comprises two side by side extending strips, an innermost strip and an outermost strip, the outermost strip being heated to a higher temperature than the innermost strip, such that the outermost strip possesses a higher adhesion than the innermost strip.

4. A method as claimed in claim 2 wherein the heated platen has an outermost edge and an innermost edge, wherein the outermost edge of said platen which forms the outer portion of the strip seal is at a higher temperature than the innermost edge of the platen which forms the inner portion of the strip seal.

5. A package comprising a base, a flexible web of plastics material covering said base and adhered to said base to define a space therebetween, and a lid sealed to said flexible web at the same region as said flexible web is adhered to said base, the sealing of said lid to said flexible web being by way of a strip seal having an inner portion and an outer portion which extends around said base, and wherein there is a peelable adhesion gradient across the width of the strip, the inner portion of the strip seal being adjacent the space and having a lower adhesion than the outer portion thereof, such that, said flexible web is inhibited against rupturing when said lid is peeled from said package.

6. A package as claimed in claim 5 wherein said strip seal comprises two seals, an innermost seal and an outermost seal which extend side by side, and wherein the outermost seal has a higher adhesion than the innermost seal.

7. A package as claimed in claim 6 wherein the innermost seal is between the base and the flexible web.

8. A package as claimed in claim 5 wherein the flexible web is of a plastisticised polyvinyl chloride, and a surface of the base and a surface of the lid which are adjacent to the flexible web include an amorphous poly(ethylene terephthalate).

9. A package as claimed in claim 8 wherein meat is contained on said base under said flexible web and in said space, and wherein there is a gas between said lid and said flexible web which is capable of enhancing the preservation of the meat by permeating the flexible web.

10. A package as claimed in claim 8 wherein the base has a cup shaped depression in which the meat is received, and a lip which surrounds the depression and wherein the strip seal is on said lip.

11. Apparatus for sealing a peelable lid to a package which contains a base and a flexible web of plastics covering and held to the base which together define a space therebetween for receipt of goods, said base having a cup shaped depression on which said goods are received and a peripheral lip surrounding said cup shaped depression, said apparatus comprising a lower chamber part to receive said base and said flexible web, platen means for heat sealing said lid to said flexible web and to cause adhesion of said flexible web to said lip, said platen forming a sealing strip surface around said depression and alignable with said lip, said sealing strip having an inner portion and an outer portion;

means for heating said platen so said sealing strip surface has a temperature gradient thereacross, such that a higher temperature is applied at the outer portion of said sealing strip surface; and means for moving said platen means to effect such sealing and adhesion.

12. Apparatus as claimed in claim 11 wherein said platen is a two part platen which forms two sealing strips, a first part forming an outermost sealing strip and a second part forming an innermost sealing strip.

13. Apparatus as claimed in claim 11 further including a cooled platen; and means for moving the cooled platen so as to clamp the lid, the flexible web and the lip of the base together before said platen means is moved to effect said sealing and adhesion.

14. A method of sealing a peelable lid to a package which contains a base and a flexible web of plastics material covering and held to the base at the perimeter thereof which together define a space therebetween, said method comprising the steps of:

placing said lid over said flexible web;

sealing said lid by a thermosealing process to said flexible web over said base with a strip seal by applying a heated platen to the lid and effecting a thermo sealing adhesion, said strip seal having an inner portion and an outer portion and extending around the perimeter of said base, said thermosealing process providing a temperature gradient across the width of the strip like seal from the inner portion to the outer portion thereof, said seal further having a peelable adhesion gradient across the width of said strip seal, the inner portion of the seal which is adjacent the space having an adhesion which is lower than the adhesion of the outer portion of said seal so that when said lid is stripped from said package, said flexible web is unlikely to rupture.

15. A method of producing a gas barrier package which comprises a first gas barrier web, a gas permeable web of plastics material covering and held to the first gas barrier web to define a goods containing space therebetween, and a second gas barrier web covering said gas permeable web and peelably sealed relative to said first gas barrier web to define a gas barrier packaging containing said goods, said method having the steps of:

sealing said gas permeable web to said first gas barrier web with a first strip seal which extends around said space and closes said space containing goods;

sealing said second gas barrier web relative to said first gas barrier web by a second strip seal which is peelable and which extends around said first gas barrier web external of said first strip seal to define said gas barrier package;

so that when said second gas barrier web is peeled to open said gas barrier package, said first strip seal remains intact and retains said gas permeable web sealed to said first gas barrier web with goods therebetween, such that gas can permeate said gas permeable web and contact said goods.

16. A method as recited in claim 15 wherein said second strip seal is produced by the step of applying a heated platen to form said second strip seal between said second gas barrier web and said first gas barrier web and effecting thermosealing adhesion therebetween.

17. A method as recited in claim 16 wherein said heated platen is a two part platen which includes an innermost part and an outermost part, the outermost part being heated to a higher temperature than the innermost part, so as to produce said second strip seal with a higher adhesion than said first strip seal.

18. A method as recited in claim 15 wherein said sealing is effected by a heated platen having an innermost edge and an outermost edge, said platen being heated so the outermost edge thereof which forms said second strip seal is at a higher temperature than the innermost edge thereof which forms the first strip seal.

19. A method as recited in claim 15 wherein said flexible web is less rigid than said first gas barrier web and is stretched and sealed to the first gas barrier web in a stretched condition.

20. A method as recited in claim 15 wherein said first gas barrier web has a cup shaped depression in which the goods are received, and a lip which surrounds the depression and wherein said first and said second strip seals are on said lip.

21. A method as recited in claim 15 further comprising introducing a gas to enhance the preservation of the goods between said first gas barrier web and said gas permeable web prior to said sealing.

22. A gas barrier package comprising a first gas barrier web and a gas permeable web of plastics material covering and sealed to said first gas barrier web to define a goods containing space therebetween;

a second gas barrier web covering said gas permeable web;

a first strip seal sealing the gas permeable web to the first gas barrier web, said first strip seal extending around and closing said space; and a second strip seal sealing said second gas barrier web relative to said first barrier web, said second strip seal being peelable and extending around said first gas barrier web external of said first strip seal, said second seal having a higher adhesion gradient than said first seal, such that when said second gas barrier web is peeled to open said gas barrier package, said first strip seal remains intact and retains said gas permeable web sealed to said first gas barrier web with goods therebetween, and wherein gas can permeate said gas permeable web to then contact said goods.

23. A package as recited in claim 22 wherein said first and said second strip seals comprise two strips which extend side by side, an innermost seal and an outermost seal, and wherein the outermost seal has a higher adhesion than the innermost seal.

24. A package as recited in claim 23 wherein the innermost seal is formed between the base and the flexible web.

25. A package as recited in claim 23 wherein the gas permeable web is of a plasticised polyvinyl chloride, and the first and second gas barrier webs each include an amorphous poly(ethylene terephthalate) along a surface which faces the flexible web.

26. A package as recited in claim 24 wherein there is meat on said base under said gas permeable web and in said space and wherein there is a gas between said second gas barrier web and said gas permeable, said gas being selected for enhancing the preservation of the meat by permeating the gas permeable web.

27. A package as recited in claim 24 wherein said first gas barrier web has a cup shaped depression in which meat is received, and a lip which surrounds the depression and wherein said first and said second strip seals are on said lip.

28. A package as recited in claim 22 wherein said gas permeable web has openings therein for permitting rapid permeation of gas therethrough.

29. A package as recited in claim 25 wherein said gas permeable web is less rigid than said first gas barrier web and is stretched over said goods and wherein said goods extend above said lip.

30. Apparatus for producing a gas barrier package comprising a first gas barrier web and a gas permeable web of plastics material covering and held to the first gas barrier web to define goods containing space therebetween, and a second gas barrier web covering said gas permeable web and peelably sealed relative to said first gas barrier web, said first gas barrier web having a cup shaped depression therein in which said goods are received and a peripheral lip surrounding said cup shaped depression, said apparatus comprising:

sealing means for providing a first strip seal between said gas permeable web and said first gas barrier web, said first strip seal extending around said space and closing said space, said sealing means also providing a second strip seal for sealing said second gas barrier web relative to said first gas barrier web with a peelable seal, said second strip seal extending around said first gas barrier web external of said first strip seal and having a higher adhesion gradient than said first seal, such that when said second gas barrier web is peeled to open said gas barrier package, said first strip seal remains intact and retains said gas permeable web sealed to said first gas barrier web with goods therebetween, and wherein gas can permeate said gas permeable web to then contact said goods.

31. Apparatus as recited in claim 30 wherein said sealing means comprises a heated platen means.

32. Apparatus as recited in claim 31 wherein said heated platen means comprises a two part platen, a first part which forms said first strip seal and a second part which forms said second strip seal.

33. Apparatus as recited in claim 32 further comprising a cooled platen;

means for moving the cooled platen to clamp said first and said second gas barrier webs and said gas permeable web prior to sealing of said first strip seal and said second strip seal by said heated platen means.

34. Apparatus as recited in claim 31 wherein said heated platen means is heated so said second strip seal will have a higher adhesion than said first strip seal.

35. A gas barrier package comprising a first gas barrier web and a gas permeable web of plastics material covering and sealed to said first gas barrier web to define a goods containing space therebetween;

a second gas barrier web covering said gas permeable web;

a first strip seal sealing the gas permeable web to the first gas barrier web, said first strip seal extending around and closing said space; and a second strip seal sealing said second gas barrier web relative to said first barrier web, said second strip seal having a higher adhesion gradient than said first seal and being peelable and extending around said first gas barrier web adjacent to said first strip seal;

such that when said second gas barrier web is peeled to open said gas barrier package, said first strip seal remains intact and retains said gas permeable web sealed to said first gas barrier web with goods therebetween, and wherein gas can permeate said gas permeable web to then contact said goods.

36. A package as recited in claim 35 wherein said first and said second strip seals comprise two strips which extend side by side, an innermost seal and an outermost seal, and wherein the outermost seal has a higher adhesion than the innermost seal.

37. A package as recited in claim 36 wherein the innermost seal is formed between the base and the flexible web.

38. A package as recited in claim 36 wherein the gas permeable web is of a plasticised polyvinyl chloride, and the first and second gas barrier webs each include an amorphous poly(ethylene terephthalate) along a surface which faces the flexible web.

39. A package as recited in claim 37 wherein there is meat on said base under said gas permeable web and in said space and wherein there is a gas between said second gas barrier web and said gas permeable, said gas being selected for enhancing the preservation of the meat by permeating the gas permeable web.

40. A package as recited in claim 37 wherein said first gas barrier web has a cup shaped depression in which meat is received, and a lip which surrounds the depression and wherein said first and said second strip seals are on said lip.

41. A package as recited in claim 35 wherein said gas permeable web has openings therein for permitting rapid permeation of gas therethrough.

42. A package as recited in claim 38 wherein said gas permeable web is less rigid than said first gas barrier web and is stretched over said goods and wherein said goods extend above said lip.

* * * * *